US010648337B2

(12) United States Patent
Overmeier et al.

(10) Patent No.: US 10,648,337 B2
(45) **Date of Patent: *May 12, 2020**

(54) ECCENTRIC SCREW PUMP

(71) Applicant: SEEPEX GmbH, Bottrop (DE)

(72) Inventors: Dirk Overmeier, Oberhausen (DE); Marcel Griesdorn, Bottrop (DE); Stefan Goethel, Bochum (DE)

(73) Assignee: SEEPEX GMBH, Bottrop (DE)

( * ) Notice: Subject to any disclaimer, the term of this patent is extended or adjusted under 35 U.S.C. 154(b) by 358 days.

This patent is subject to a terminal disclaimer.

(21) Appl. No.: 15/503,901

(22) PCT Filed: Jul. 30, 2015

(86) PCT No.: PCT/EP2015/067557

§ 371 (c)(1),
(2) Date: Mar. 1, 2017

(87) PCT Pub. No.: WO2016/034340

PCT Pub. Date: Mar. 10, 2016

(65) Prior Publication Data

US 2017/0306760 A1 Oct. 26, 2017

(30) Foreign Application Priority Data

Sep. 1, 2014 (DE) ..... 10 2014 112 550

(51) Int. Cl.
*F04C 2/107* (2006.01)
*F01C 21/10* (2006.01)
(Continued)

(52) U.S. Cl.
CPC ..... *F01C 21/104* (2013.01); *F01C 21/007* (2013.01); *F04C 2/107* (2013.01);
(Continued)

(58) Field of Classification Search
CPC .... F01C 21/107; F01C 21/104; F01C 21/007; F01C 21/102; F04C 2/107; F04C 2/1071;
(Continued)

(56) References Cited

U.S. PATENT DOCUMENTS 3,838,949 A * 10/1974 Makino ..... F04C 2/1073 418/48
5,947,527 A * 9/1999 Carter ..... F16L 21/08 285/323

(Continued)

*Primary Examiner* — Deming Wan
(74) *Attorney, Agent, or Firm* — Andrew Wilford

(57) ABSTRACT

The invention relates to an eccentric screw pump, comprising at least one stator (1) composed of an elastic material and a rotor (2) that can be rotated in the stator (1), the stator (1) being surrounded by a stator casing (3) at least in some regions. The stator casing (3) consists of at least two casing segments (19) as a longitudinally divided casing and forms a stator clamping device, by means of which the stator (2) can be clamped against the rotor (1) in the radial direction. The pump is characterized in that the casing segments (19) have at least one clamping flange (20) having first clamping surfaces (21) at each end of the casing segments and that one or more clamping elements (22, 23), which can be displaced in the axial direction and have second clamping surfaces (24), are placed onto the clamping flange (20), the first clamping surfaces (21) and the second clamping surfaces (24) being designed in such a way and interacting in such a way that the stator casing (3) can be clamped against the stator in the radial direction in the course of an axial displacement of the clamping elements (22, 23).

13 Claims, 11 Drawing Sheets

(51) Int. Cl.
*F01C 21/00* (2006.01)
*F01C 21/04* (2006.01)
*F04C 15/00* (2006.01)

(52) U.S. Cl.
CPC ..... *F04C 2/1073* (2013.01); *F04C 15/0019* (2013.01); *F04C 15/0042* (2013.01); *F04C 2240/10* (2013.01); *F04C 2240/30* (2013.01); *F04C 2240/805* (2013.01)

(58) Field of Classification Search
CPC .. F04C 2/1073; F04C 2/1075; F04C 15/0073; F04C 15/0019
USPC ..... 418/156, 48, 152, 153
See application file for complete search history.

(56) References Cited

U.S. PATENT DOCUMENTS

| | | | | |
|---|---|---|---|---|
| 7,972,076 | B2 | 7/2011 | Harris | |
| 8,182,252 | B2 | 5/2012 | Amburgey | |
| 8,439,659 | B2 | 5/2013 | Loeker | |
| 2010/0196182 | A1* | 8/2010 | Loeker ..... | F04C 2/1075 418/48 |

* cited by examiner 1
1a
1b
2
3
4
5
6
7
8
9
10
11
12
13,17
14,18
19
20
21
22
22a
22b
24
25
L

ECCENTRIC SCREW PUMP

CROSS REFERENCE TO RELATED APPLICATIONS

This application is the US-national stage of PCT application PCT/EP2015/067557 filed 30 Jul. 2015 and claiming the priority of German patent application 102014112550.9 itself filed 1 Sep. 2014.

FIELD OF THE INVENTION

The invention relates to an eccentric screw pump with at least one stator made of an elastic material and a rotor that can be rotated or is rotatably mounted in the stator, with the stator surrounded at least in some regions by a stator casing, which is also referred to as a stator housing, and with the stator casing axially split and consisting of at least two casing segments and forming a stator clamp with which the stator can be clamped against the rotor radially.

BACKGROUND OF THE INVENTION

In such an eccentric screw pump, the rotor is normally connected to the drive or drive shaft by at least one coupling rod that is also referred to as a Cardan shaft. The pump has a intake housing as well as a connector, and the stator is connected with one of its ends to a connecting flange of the intake housing and at its other end to a connecting flange of the connector. In the context of the invention, "elastic material" refers particularly to an elastomer, for example a (synthetic) rubber or a rubber mixture. Composite materials made of an elastomer or of another material, such as metal, for example, are also included. The (elastomeric) stator is preferably formed as an axially split stator composed of at least two stator subshells. In such an eccentric screw pump, the (split) stator can be exchanged separately from the stator casing and, consequently, is not permanently and particularly not integrally connected to the stator casing. It is therefore also possible to exchange the elastomeric stator separately from the stator casing, particularly without the necessity of laboriously breaking down the pump. The stator is preferably composed of two stator half-shells. The stator casing is composed of at least two casing segments, for example three casing segments or four casing segments that form a stator clamp. After all, the stator or the stator subshells rest with sealing end faces against corresponding sealing end faces on the respective housing part (intake housing or connector) or on corresponding adapters.

An eccentric screw pump of the type mentioned at the outset is known, for example, from WO 2009/024279 [U.S. Pat. No. 8,439,659]. The casing segments of the stator casing have end mounting flanges that are connected using clamping means to the connecting flanges of the intake housing or connector or to separate adapters for the purpose of clamping the stator. These clamping means are formed as clamping screw devices that are formed essentially as clamping screws that work radially. The known eccentric screw pump has outstandingly proven its worth. One aspect that is especially advantageous is the fact that the clamping pressure of the stator can be adjusted, thus enabling its operation to be optimized after it becomes worn, for example. Taking this as a point of departure, however, the known measures have potential for development. This is where the invention comes in.

It is the object of the invention to provide an eccentric screw pump of the type described above in which the stator can be reliably reclamped, preferably even under higher loads. To achieve this object, the invention teaches in relation to a generic eccentric screw pump of the type described above that the end casing segments each have at least one clamping flange with first clamping surfaces, and that one or more clamping elements with second clamping surfaces are placed onto the clamping flange or the clamping flanges, with the first clamping surfaces and the second clamping surfaces being formed such and coacting such that the stator casing can be pressed against the stator radially on axial displacement of the clamping elements. The first clamping surfaces and/or the second clamping surfaces are formed as wedges. The clamping elements are then frustoconical, for example with inner frustoconical surfaces. The clamping flanges are correspondingly frustoconical, for example with outer frustoconical surfaces. Preferably, both the first clamping surfaces and the second clamping surfaces are formed as wedges that then optionally abut against one another on a common contact surface. However, the contact between the two clamping surfaces, for example wedges, can also be limited to linear contact.

The invention proceeds in this regard initially from the insight that the possibility of adjusting and clamping, particularly of reclamping the stator, is of special importance. According to the invention, this possibility exists in a fundamentally known manner through the aid of the casing segments that are also referred to as adjusting segments and are designed for the purpose of setting the stator clamping and reclamping the stator and therefore constitute a stator clamp. According to the invention, the clamping of the casing segments is now no longer performed directly by radially oriented set screws, but rather "indirectly" by one or more clamping elements that are displaced axially in order to clamp the stator and exert a radial force against the stator on this axial displacement. The coacting clamping surfaces are provided for this purpose and are especially preferably formed as wedges. Due to the configuration of these clamping surfaces or wedges, a "deflection" of the axial force into a radial clamping force occurs. The displacement of the clamping elements or clamping element can be achieved using conventional actuating elements, such as set screws, for example that then do not act radially, however, but rather along or parallel to the axis. With such actuating elements, the clamping element can be displaced axially and thus generate the radial clamping force. It is advantageous here that the actuating elements, for example set screws, must absorb forces primarily on clamping and hence adjustment. During operation, however, only lesser forces have to be absorbed by the actuating elements, for example set screws, because the forces are absorbed for the most part indirectly or directly by the clamping elements that can be displaced axially. In a first embodiment of the invention, a (continuous) clamping ring with an annular second clamping surface is provided as a clamping element, and this second clamping surface of the clamping ring coacts with the first clamping surfaces of the casing segments. Together with its (inner) wedge, this clamping ring forms a frustoconical ring or encompasses a frustoconical ring. The clamping ring can be displaced axially for clamping using suitable actuating elements, such as set screws, so that radial forces are produced on axial displacement with the aid of the corresponding clamping surfaces, for example wedges. During clamping, the clamping forces are applied with the actuating elements, for example set screws, and during operation of the pump, the great forces that then occur can be absorbed by the annular clamping ring, so that the actuating elements themselves, for example set screws, are unburdened for the most part.

In an alternative, second embodiment, it is possible to use not an annular clamping ring, but several individual clamping segments, in which case the individual clamping segments each have a second clamping surface that coacts with the first clamping surfaces of the casing segments. Such individual casing segments can also be displaced axially using suitable actuating elements and the axial actuating movement converted into a radial clamping force by the clamping surfaces, for example wedges. It is expedient here if the corresponding housing parts of the pump or corresponding adapters that are known in principle from the prior art are equipped with suitable holders for the individual clamping segments. It thus lies within the scope of the invention for the housing parts of the pump or their adapters to have receiving pockets that receive the clamping segments and hold and fix them radially and angularly, so that the clamping segments can be displaced in these pockets along or parallel to the axis.

The overall aim of the invention is, on the one hand, to provide clamping elements, such as a clamping ring or several clamping segments that can be displaced in an axial and/or axially parallel manner, and, on the other hand, to provide actuating elements, so that the "clamping" on the one hand and the "holding" on the other hand are uncoupled during operation, thereby unburdening the actuating elements during operation. This offers the advantage, for example, that even pumps with higher loads and particularly higher operating pressures can be reclamped in the inherently known manner with the aid of casing segments or adjusting segments. Set screws can be used as actuating elements, for example, but they do not act radially directly on the casing segments like in the prior art; instead, they act indirectly on the casing segments via the clamping element and are preferably oriented in the axially parallel direction for this purpose. It lies within the scope of the invention for the two stator ends to each be provided with several set screws. The set screws can be formed as pressure screws or as lag screws. Alternatively, it lies within the scope of the invention to clamp the opposing clamping elements, for example clamping rings, against one another using common clamping rods. However, the invention also includes other embodiments in which it is not set screws or adjusting rods or clamping rods that are used, but clamping or adjusting levers that are connected to the clamping elements, for example the clamping ring. For instance, the two opposing clamping rings can be interconnected and pressed against one another by a suitable lever construction. Alternatively, a rotatable adjusting ring can also be provided as an actuating element; this will be discussed further below.

In another embodiment, the clamping ring can have a multipart design and consist at least of an outer ring and an inner ring, in which case the actuating elements, for example set screws, act on the outer ring and the clamping surfaces, for example wedges, are arranged on the inner ring that is then formed as a frustoconical ring. In this regard, the invention proceeds from the insight that it is expedient if the clamping ring has a multipart design consisting of different materials, it being possible for the outer ring to be made of steel or also of cast steel, for example, and for the inner ring to be made of a corrosion-resistant material having good sliding properties, such as brass. This two-part configuration enables optimal adaptation of the materials.

Alternatively, it lies within the scope of the invention for the clamp to have at least one separate clamping subassembly that has a double wedge ring having the second clamping surfaces and enclosing the casing segments, as well as two clamping rings that can be pressed against one another and have the first clamping surfaces. As a result, in this embodiment, the clamping flanges with the clamping surfaces (wedges) are not permanently connected to the respective casing segments, but rather a separate component, namely the double wedge ring, is made available with the first clamping surfaces, it being possible for this double wedge ring to also be replaced by several individual double wedge segments, in which case a double wedge segment is then especially preferably associated with each casing segment.

The clamping is then performed with two clamping rings that can be pressed against one another, with these clamping rings being pressed against one another through the interposition of the double wedge segments or of a double wedge ring. The wedge principle according to the invention is put into practice here as well; after all, the double wedge segments pressed against one another on axial displacement of the two clamping rings radially and consequently pressed against the casing segments. The described advantages according to the invention can be achieved in this way as well.

If set screws are used as actuating elements, it can be expedient if these set screws are oriented (exactly) parallel to the axis. Alternatively, however, it also lies within the scope of the invention to arrange the set screws obliquely, especially preferably parallel or substantially parallel to the first wedges and second wedges. The set screws thus act parallel to the direction of motion of the components on clamping.

In a modified embodiment, it is proposed that the clamping ring be held in a rotating manner and displaced axially and automatically on rotation. This can be achieved, for example, by guiding the clamping ring over a threaded connection on the corresponding housing part or connection adapter, for example by providing the housing part or connection adapter with an outer thread and the clamping ring with the corresponding inner thread. During rotation of the clamping ring on the housing part, the latter is then displaced axially simultaneously toward a closed position. In such an embodiment, it can be expedient to provide the rotatable clamping ring on its outer periphery with teeth so that a corresponding drive can engage therein, for example. Another embodiment of the invention is that a rotatable adjusting ring or a rotatable adjusting ring assembly that effects an axial displacement of the clamping ring or of the clamping segments on rotation is provided as an actuating element. Consequently, in this embodiment, set screws or the like do not act directly on the clamping ring for the displacement; instead, a separate rotatable adjusting ring is provided that produces an axial displacement of the clamping ring on rotation. Here, though, it is not the clamping ring itself that is rotated—as is the case in the embodiment discussed previously—but rather the adjusting ring. As explained in connection with the clamping ring, the adjusting ring can be arranged via a threaded connection on the housing part, so that the adjusting ring is displaced axially on rotation, thereby also axially displacing the clamping ring.

Alternatively, the possibility exists of the adjusting ring being rotatable on the housing part but not itself being displaced axially, but rather with only the clamping ring being displaced axially. This can be achieved, for example, if the adjusting ring has one or more angled faces or oblique support surfaces on the surface facing toward the clamping ring, and/or if the clamping ring has angled faces or oblique support surfaces (corresponding) to the adjusting ring, so that the "total thickness" of adjusting ring on the one hand and clamping ring on the other hand based on the optionally corresponding angled faces changes on rotation, so that the clamping ring is displaced axially.

One embodiment with a rotatable adjusting ring can also be formed such that the adjusting ring and/or the clamping ring is provided with recesses that are formed as guides for rolling and/or sliding bodies, in which case recesses such as rolling bodies, for example (balls, cylinders, or the like) are guided in these recesses, and these rolling and/or sliding bodies act on or press against the clamping element, for example the clamping ring. These guides or recesses extend arcuately along the annular direction over a certain annular or angular range of the adjusting ring and/or clamping ring. They are formed such that the rolling and/or sliding bodies are guided along in the recess on rotation of the adjusting ring angularly, moving in the axial or axially parallel direction and thus actuating the clamping ring axially. For this purpose, recesses can either be provided only in the adjusting ring or only in the clamping ring, or corresponding recesses can be preferably provided both in the adjusting ring and in the clamping ring. In the latter case, the rolling and/or sliding bodies are then guided in the corresponding recesses both of the adjusting ring and of the clamping ring. The recesses can have a tapering width over their length (i.e. angularly of the ring), so that, if balls are used, for example, the balls migrate in these wedge-shaped, tapering recesses during the rotation of the adjusting ring and are pressed out of the recesses. The balls thus move axially on rotation, thereby actuating the clamping ring axially. Especially preferably, however, the recesses are formed as pocket-like, arcuate grooves having a groove depth that decreases from one end to the other. It is expedient if, as a result, it is not (only) that the width of the groove tapers, but the groove rises, so that the rolling and/or sliding body is not guided on the edges but rather rests on the rising base of the groove. In any case, this embodiment with guides and corresponding guide bodies (rolling and/or sliding bodies) also ensures that the "total thickness" of adjusting ring on the one hand and clamping ring on the other hand will change on rotation of the adjusting ring, thereby displacing the clamping ring axially.

Furthermore, it lies within the scope of the invention to manually actuate the actuating elements for actuating the clamping ring for adjusting and reclamping, for example by actuating set screws or the like with suitable tools.

In one possible development, it is proposed that the stator clamp additionally comprises one or more actuators that act so as to automatically advance the actuating elements.

The invention places emphasis primarily on the configuration with the clamping elements with corresponding clamping surfaces, for example wedges. In addition, it is advantageous if locking fittings, for example projections or recesses, are arranged on the clamping flanges of the casing segments that prevent rotation and/or axial movement by coacting with corresponding locking fittings, for example recesses or projections, on a housing part of the pump or on separate adapters. For this purpose, T-shaped projections can be connected to these casing segment projections, for example, that engage in corresponding recesses on the respective housing part or adapter, for example T-section grooves, so that the casing segments on the housing parts or adapters are secured against twisting and against axial movement. Nonetheless, movements of the casing segments radially for clamping are permitted. These locking fittings can be molded directly and integrally on the casing segments or molded into the housing part or adapter. Alternatively, however, it also lies within the scope of the invention to attach such projections to the casing segment or on the housing part or adapter as separate components.

BRIEF DESCRIPTION OF THE DRAWING

The invention is described in further detail below with reference to a schematic drawing showing a single embodiment.

SPECIFIC DESCRIPTION OF THE INVENTION

Figure 1:
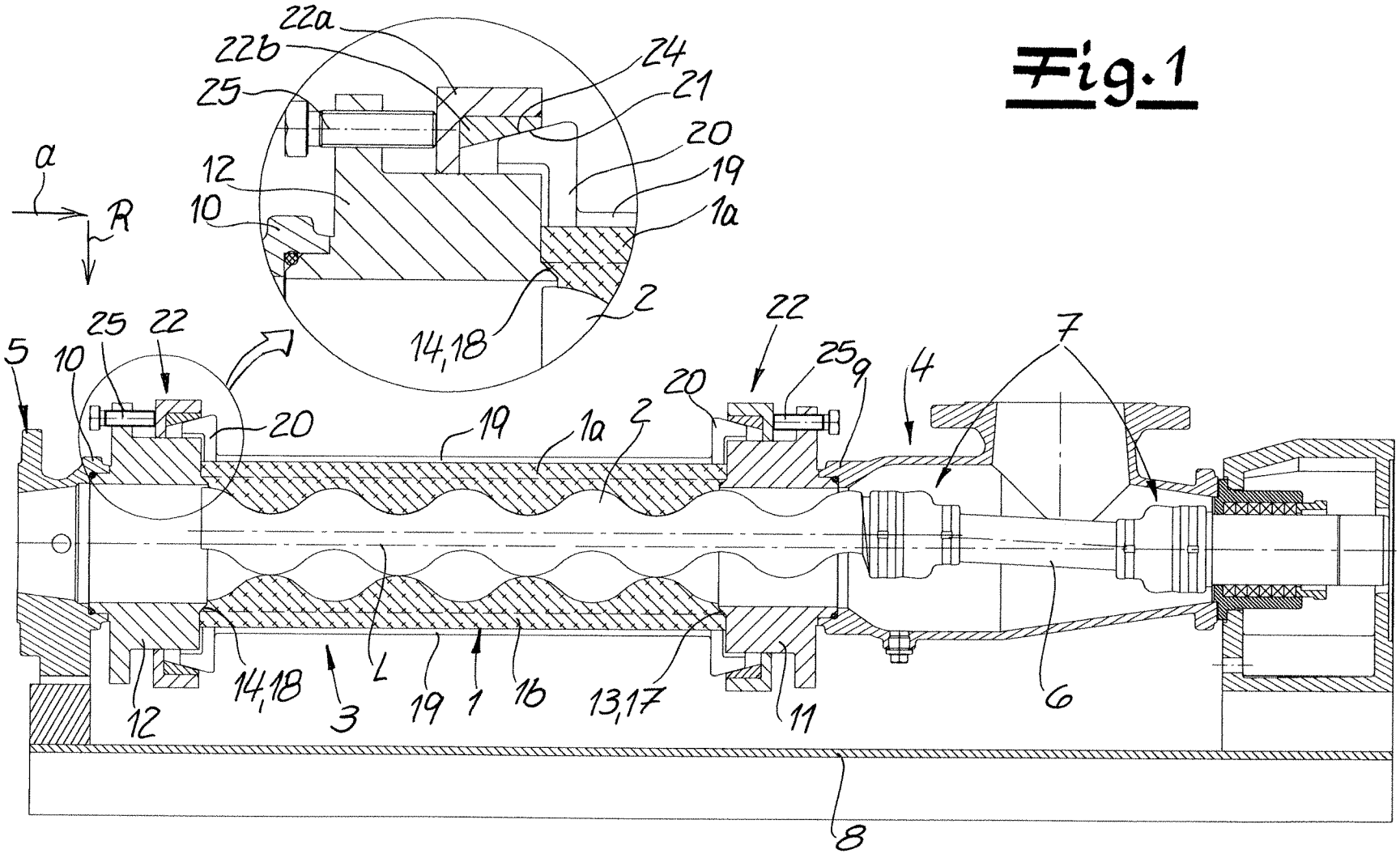
FIG. 1 is a section through a first embodiment of an eccentric screw pump according to the invention.

The figures show an eccentric screw pump that, in its basic construction, has a stator 1 made of an elastic material and a rotor 2 supported in the stator 1 that is surrounded at least in some regions by a stator casing 3. Furthermore, the pump has a intake housing 4 as well as a connector 5 that is also referred to as a pump output nozzle. An unillustrated drive is also provided and is connected by a coupling rod 6 to the rotor 2. The coupling rod is connected via coupling joints 7 to the rotor 2 at one end and to a shaft of the drive at the opposite end. The pump is usually mounted on a base plate 8 that is either delivered with the pump or also a base plate 8. The stator 1 is connected in an inherently known manner at one end to a connecting flange 9 of the intake housing 4 and at its other end to a connecting flange 10 of the connector 5. In the illustrated embodiment, the connection is not made directly to these connecting flanges 9, 10, but rather through interposition a respective adapters 11 and 12. These adapters 11, 12 are also referred to as centering rings or segment holders.

The stator 1 is formed as an axially split stator and consists of two stator subshells 1*a*, 1*b* that form in the illustrated embodiment half-shells that each cover an angle of 180°. "Axially split" means divided along the stator longitudinal axis L or parallel thereto. The separating plane between the subshells therefore runs along or parallel to the longitudinal axis L. This axially split configuration of the elastomeric stator makes it possible to disassemble and reassemble the stator 1 while the intake housing 4, pump output nozzle 5, and rotor 2 are mounted. Reference is made in this regard to WO 2009/024279.

In order to ensure the proper tightness of the stator despite this split construction, the stator 1 or its stator subshells 1*a*, 1*b* have sealing end faces 13, 14. The stator subshells 1*a*, 1*b* can be mounted with their sealing end faces 13, 14 on stator holders that are provided on the adapters 11, 12 in the embodiment illustrated here. The adapters 11, 12 themselves can be inserted into inherently known holders of the intake housing 4 and pump output nozzle 5, so that the intake housing 4 on the one hand and the pump output nozzle 5 on the other hand can be formed in a conventional configuration. The sealing end faces 13, 14 of the stator 1 are frustoconical or formed as frustoconical surfaces, and they are particularly provided with "inner frustoconical surfaces" in the illustrated embodiment. The stator holders also have complementary frustoconical sealing counter-surfaces 17, 18 that can be outer frustoconical surfaces in the illustrated embodiment. The seal is achieved through rubber compression. The fixing and sealing of the stator subshells 1*a*, 1*b* is done with the aid of the stator casing 3. This is formed as an axially split casing and has several casing segments 19 for this purpose—four in the illustrated embodiment. This stator casing 3 forms with its casing segments 19 a stator clamp or stator adjusting device with which the axially split stator 1 can be fixed and sealed on the one hand and a desired tension or pretension can be applied to the stator 1 on the other hand.

To this end, the casing segments 19 have clamping flanges 20 at their ends with first clamping surfaces 21 that are formed as wedges 21 in the illustrated embodiment. Clamping elements 22, 23 (FIGS. 4*a*-D) are placed on the clamping flanges 20 and provided with second clamping surfaces that are also formed as wedges 24. The first clamping surfaces 21 and the second clamping surfaces 24 are formed and coact such that the stator 3 and casing 19 are biased radially against the stator 1 by axial displacement of the clamping elements 22, 23.

FIG. 1 shows a first embodiment in which a completely annular clamping ring 22 is provided as a clamping element that (internally) has an annular second clamping surface 24 that coacts with the first clamping surfaces 21 of the casing segments 19. FIG. 1 shows that, on movement of the clamping ring 22 in the axial direction a, a clamping force is produced by to the coacting wedges 21 and 24 that acts in a radial direction R. For the purpose of displacing the clamping ring 22 in the direction a, actuating elements 25 are provided that are formed as set screws 25 in the illustrated embodiment according to FIG. 1. In the illustrated embodiment, these actuating elements or set screws 25 are on the adapters 11, 12. In embodiments without adapters, they would be held in an appropriate manner on the housing parts, namely the intake housing 4 and the connector 5. Moreover, it can be seen in FIG. 1 that the clamping ring 22 in the illustrated embodiment has a multipart configuration and consists of an outer ring 22*a* and an inner ring 22*b*, with the set screws 25 pressing on the outer ring 22*a* and the wedges 24 on the frustoconical inner ring 22*b*.

Figure 2:
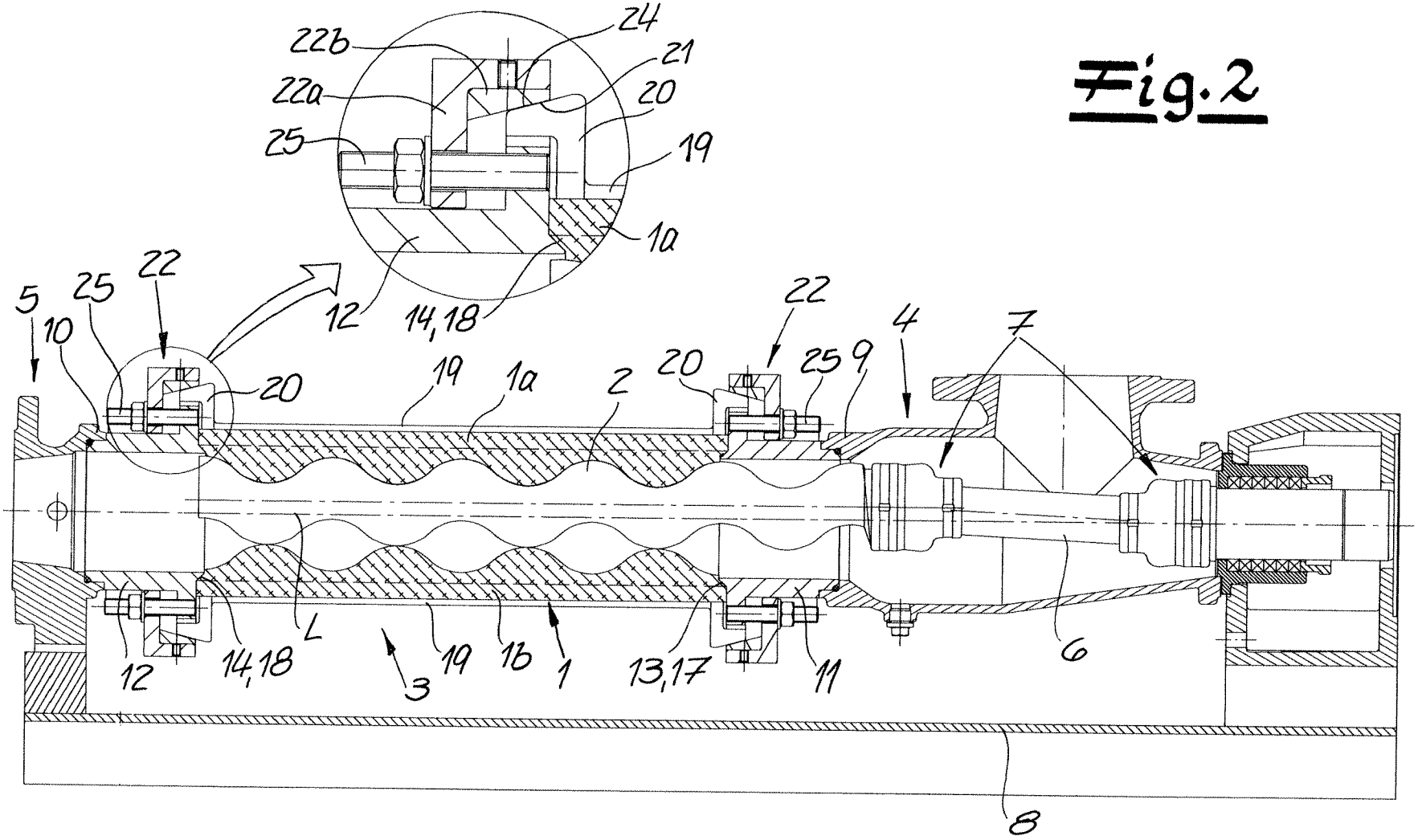
FIG. 2 shows a second embodiment of the pump of FIG. 1.

The construction and functionality of the second embodiment according to FIG. 2 correspond to those of the embodiment according to FIG. 1, except that the set screws 25 according to FIG. 1 are formed as pressure screws and those according to FIG. 2 are formed as lag screws.

Figure 3:
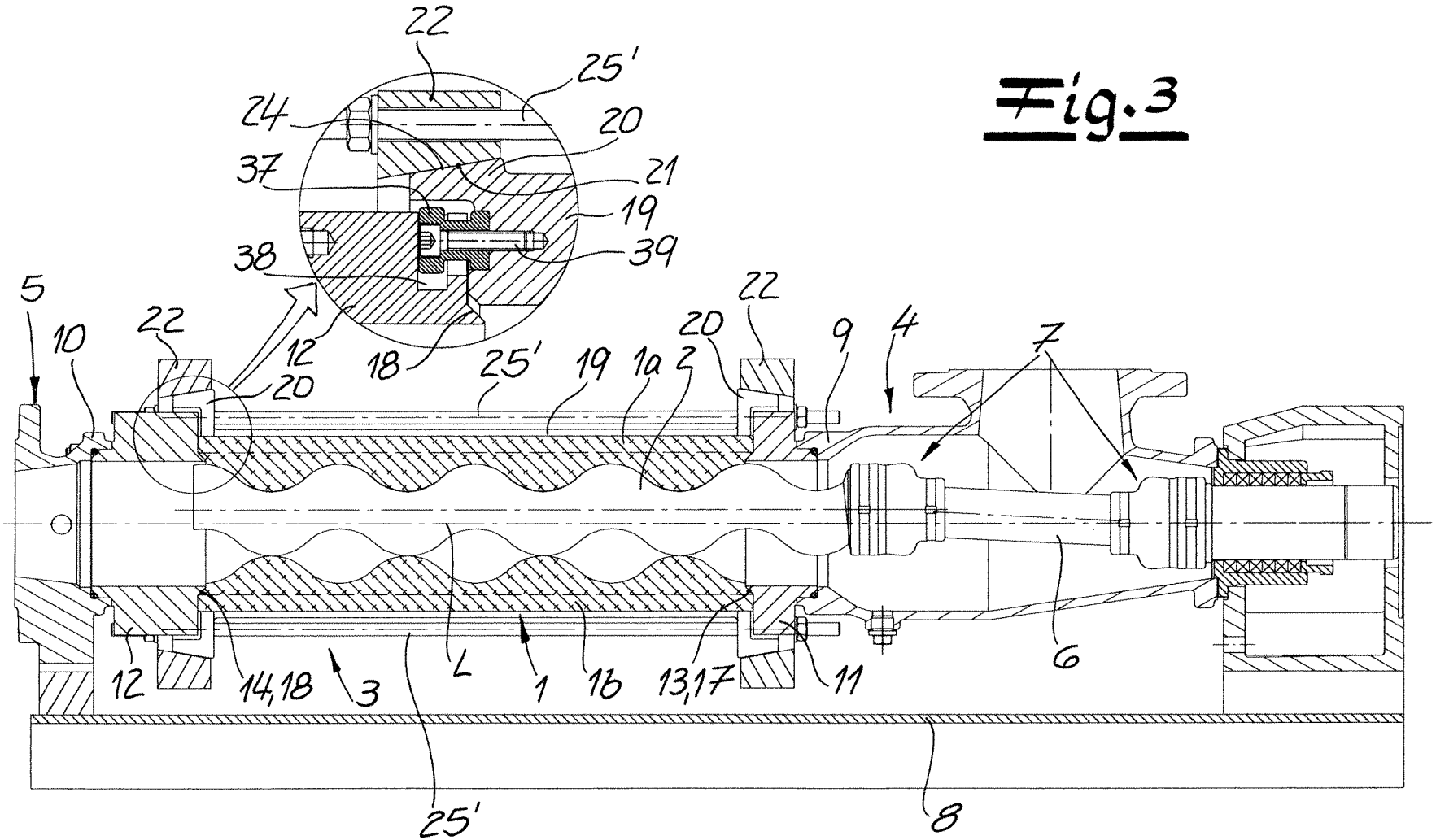
FIG. 3 shows a third embodiment of the invention.
Figure 4A:
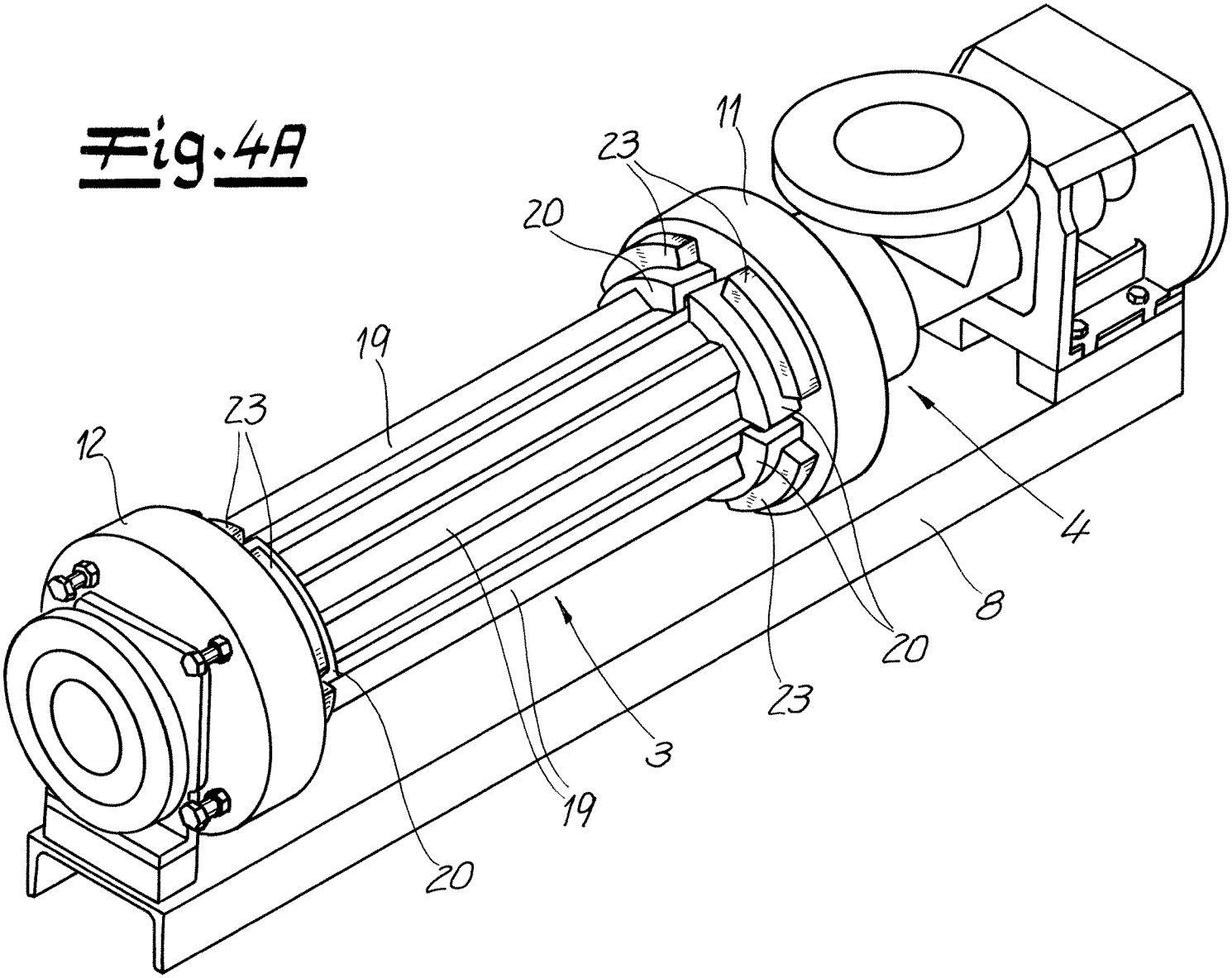
FIG. 4*a* is a perspective view of a fourth embodiment of the invention.
Figure 4B:
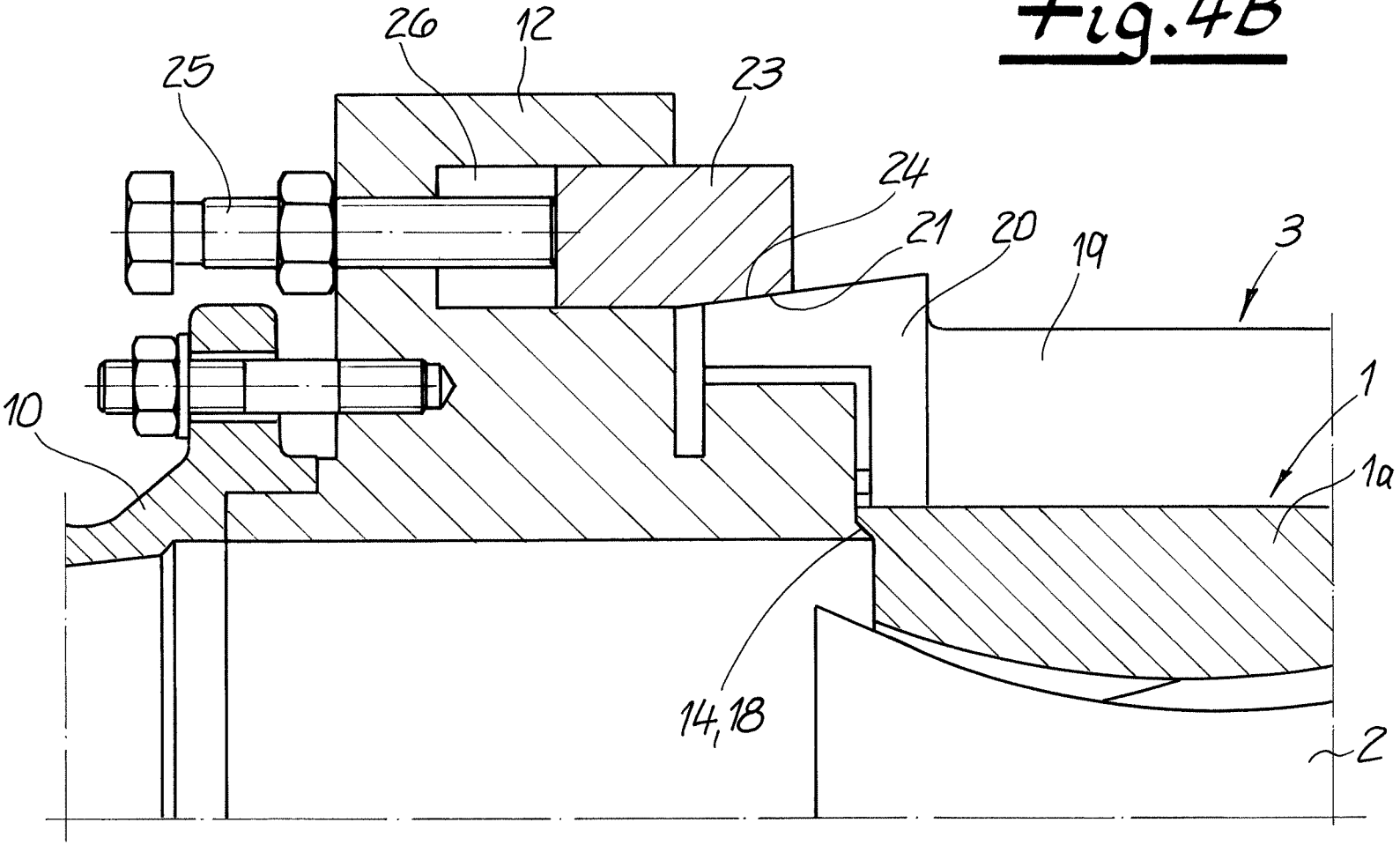
FIG. 4*b* is an enlarged section through the pump of FIG. 4*a;*
Figure 4C:
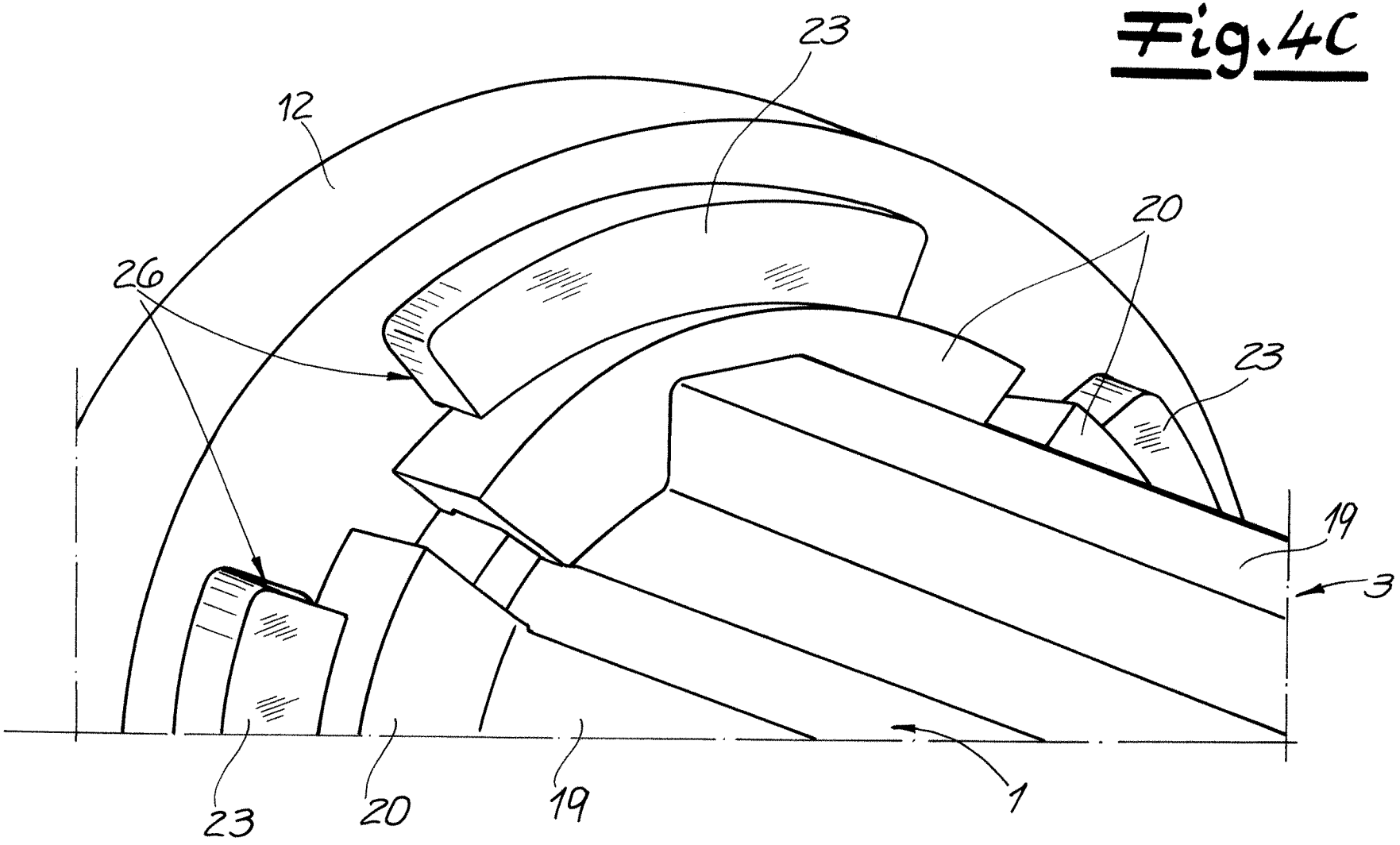
FIG. 4*c* is another enlarged view of the pump of FIG. 4*a;*
Figure 4D:
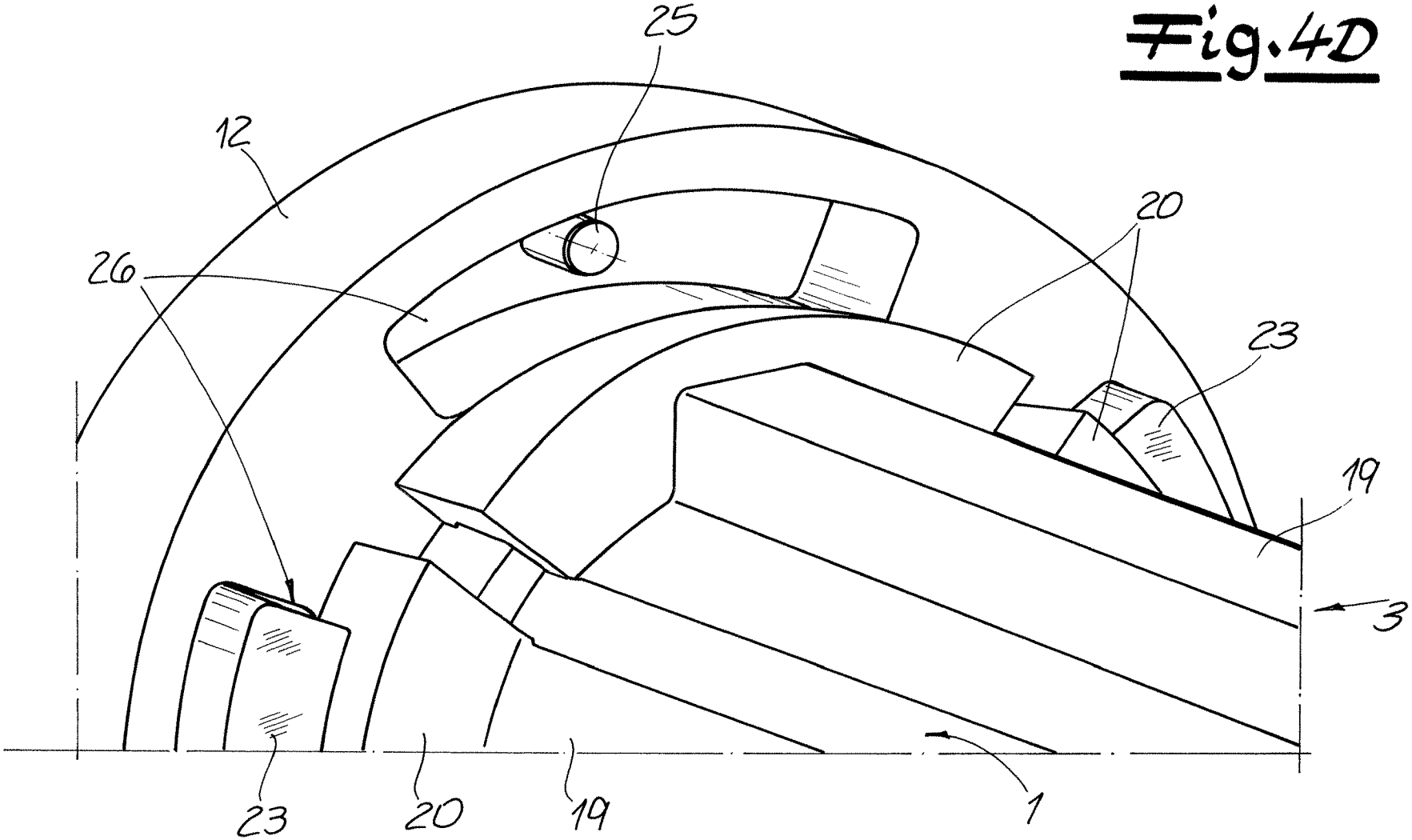
FIG. 4*d* shows a modified version of the pump of FIG. 4*c;*

In the embodiment according to FIG. 3, adjusting rods or clamping rods 25 are provided as actuating elements with which the two clamping rings 22 are pressed against one another. While FIGS. 1 to 3 show embodiments with annular clamping ring 22, a modified fourth embodiment is illustrated in FIGS. 4A and 4B in which several individual clamping segments 23 are provided as actuating elements, each of which has second clamping surfaces 24, with these second clamping surfaces 24 coacting with the first clamping surfaces 21 of the casing segments 19. A comparison of FIGS. 4A to 4D shows that a clamping segment 23 is associated with each casing segment 19 at each of its ends. The clamping segments 23 are received in suitable recesses or holders 26 in the adapters 11, 12. Set screws 25 are provided as actuating elements that are held on the adapters 11, 12 and act on the clamping segments 23. This embodiment also functions according to the wedge principle according to the invention.

Figure 5:
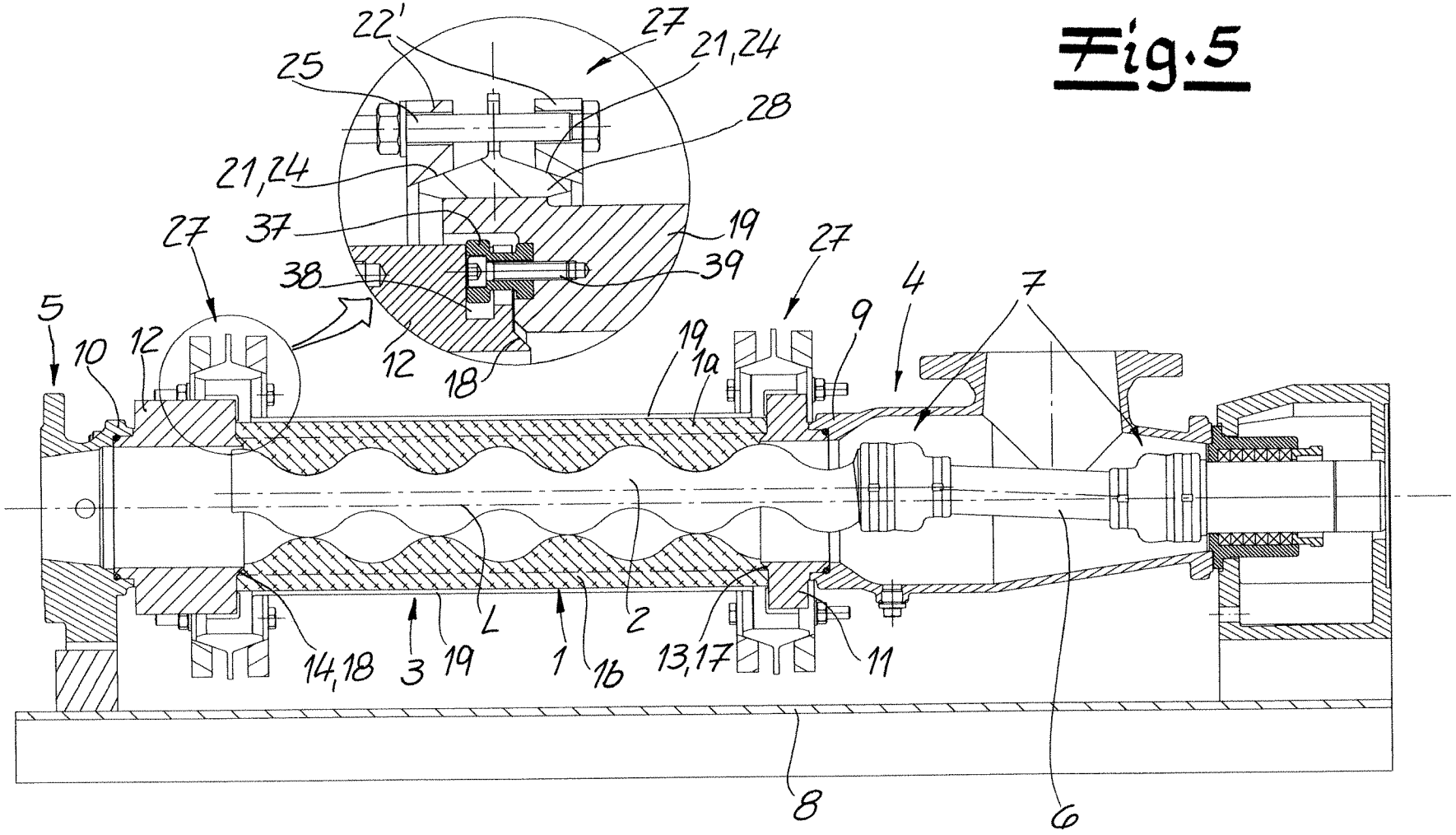
FIG. 5 is a section through a fifth embodiment of the invention.

FIG. 5 shows another embodiment in which the clamp has a separate clamping subassembly 27 at each stator end. This separate clamping subassembly 27 has several double wedge segments 28 as well as two clamping rings 22 that can be pressed together. The double wedge segments 28 have exterior first wedges 21, and both clamping rings 22 have interior second wedges 24. The two clamping rings 22 are pressed against one another through interposition of the double wedge segments 28, so that, on clamping and consequently the displacement of the two clamping rings 22', the wedge segments 28 are displaced radially and thus act on the stator casing 3 radially. In the illustrated embodiment, a double wedge segment 28 is associated with each casing segment 19 at the respective end.

Figure 6:
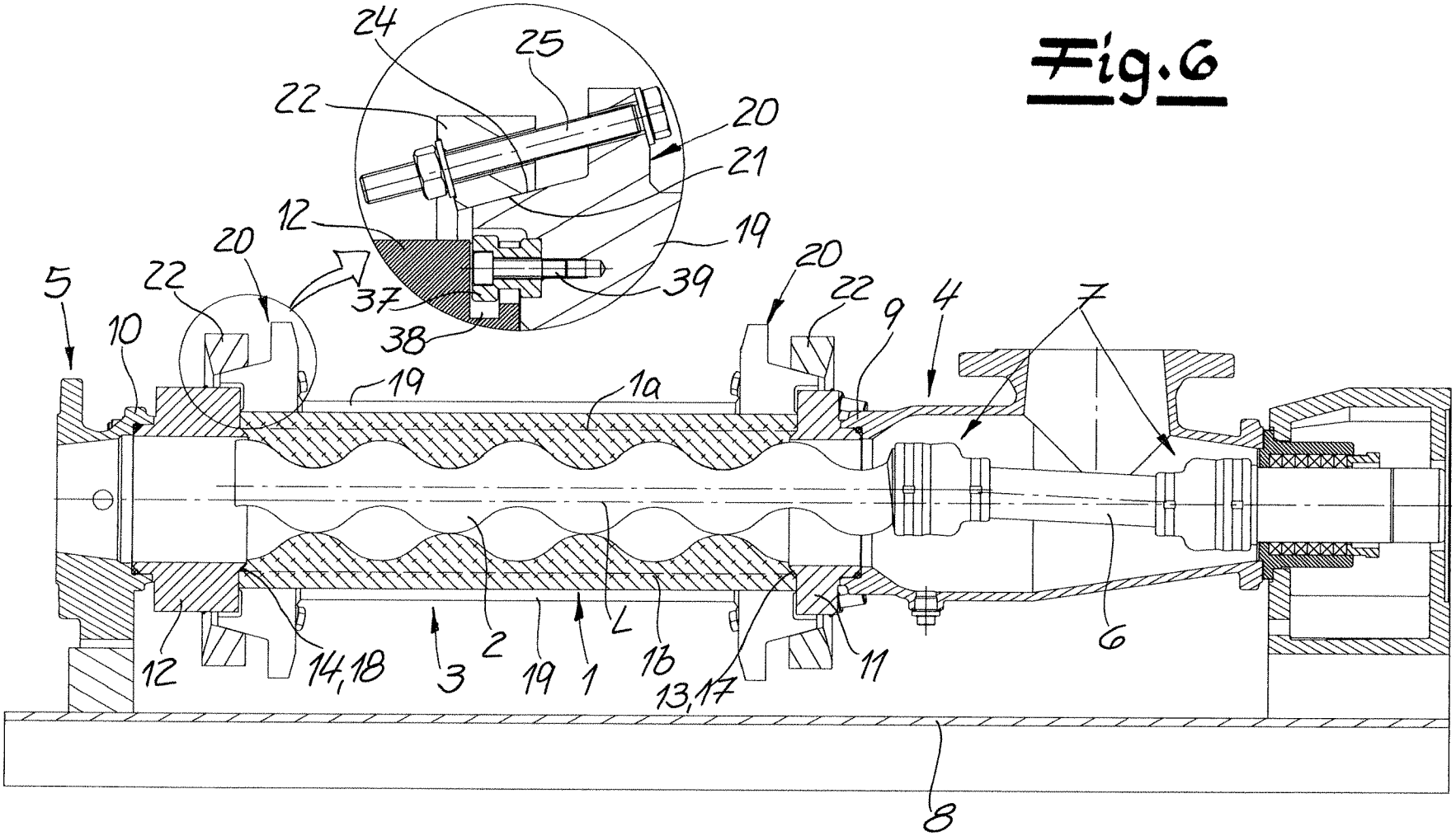
FIG. 6 shows a sixth embodiment of the pump of FIG. 1.
Figure 7:
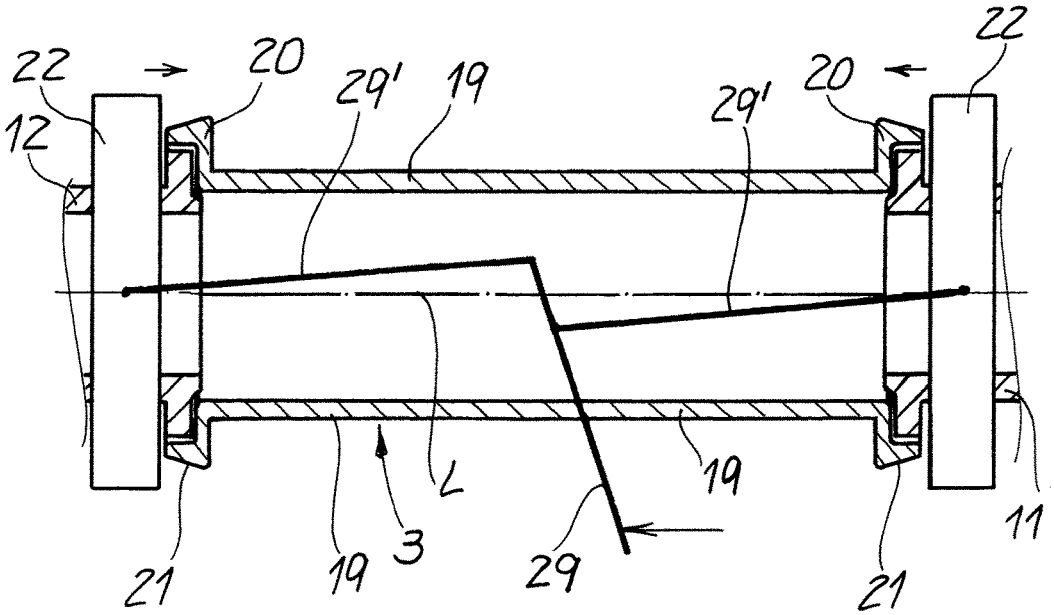
FIG. 7 shows a modified seventh embodiment of the invention.

FIG. 6 shows a modified embodiment that corresponds in its basic configuration to the embodiments according to FIGS. 1 and 2. While the set screws 25 extend axially in FIGS. 1 and 2, FIG. 6 shows an embodiment in which the set screws 25 extend obliquely, specifically substantially parallel to the wedges 21, 24 in the illustrated embodiment and therefore also parallel to the direction of motion of the casing segments 19 during clamping. While FIGS. 1 to 6 show embodiments in which set screws 25 or adjusting rods 25 or clamping rods are used as actuating elements, FIGS. 7 to 10 show modified embodiments in which other actuating mechanisms are employed. For instance, FIG. 7 shows an embodiment in which the two clamping rings 22 are displaced by moving a lever; for that purpose, at least one link rod or connecting rod 29 is connected to each clamping ring, and the two connecting rods 29 are interconnected by a common tension lever 29. In this embodiment, two respective connecting rods 29 are connected to each wedge ring 22.

Figure 8:
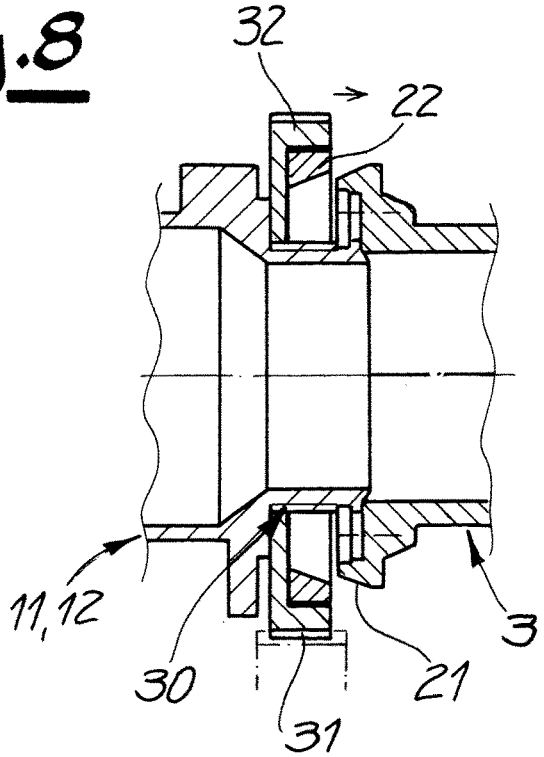
FIG. 8 shows an eighth embodiment of the invention.

FIG. 8 shows a modified embodiment in which a rotatable adjusting ring 32 is provided as an actuating element that acts on the clamping ring 22, although the clamping ring 22 itself does not rotate along, but rather is displaced axially when rotated. For this purpose, the adjusting ring 32 is secured by a threaded connection 30 on the corresponding housing part or connection adapter 11, 12. On rotation of the clamping ring 32, it rotates axially on the housing part or adapter 11, 12 as a result of the threaded connection 30, so that the clamping ring 22 is thus also displaced with the wedges and the casing segments are clamped. To actuate this rotatable adjusting ring 32, it can be provided on its outer periphery with teeth 31, so that a drive gear can act on the outer periphery of the adjusting ring, for example.

Figure 9:
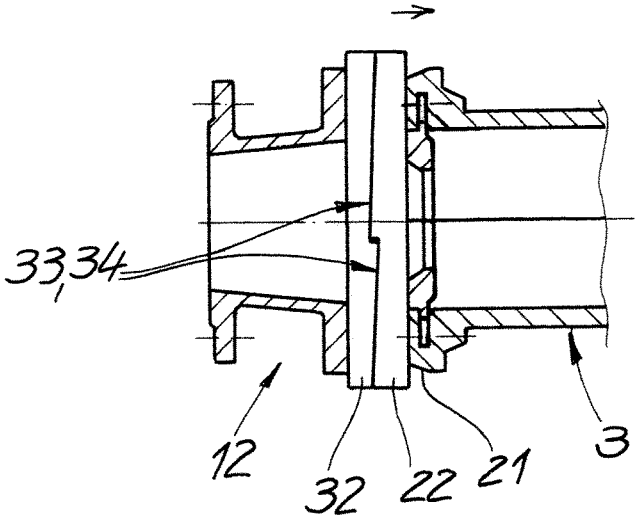
FIG. 9 shows a ninth embodiment of the invention.

FIG. 9 shows an embodiment in which a separate rotatable adjusting ring 32 or an adjusting ring assembly is also provided as an actuating element. On rotation of the adjusting ring 32, the clamping or frustoconical ring 22 is displaced axially by the wedges (not shown). For this purpose, the adjusting ring 32 has on its surface facing toward the clamping ring 22 one or more angled faces 33. On its surface facing toward the adjusting ring 32, the clamping ring 22 has corresponding angled faces 34. These angled faces 33 and 34 coact such that, on rotation of the adjusting ring 32, the clamping ring 22 is displaced axially. In this embodiment, in contrast to the embodiment according to FIG. 8, the clamping ring 22 moves only axially, whereas the adjusting ring 32 only rotates. The rotation of the adjusting ring 32 can effected by a set screw (not shown) or also an automated drive.

Figure 10:
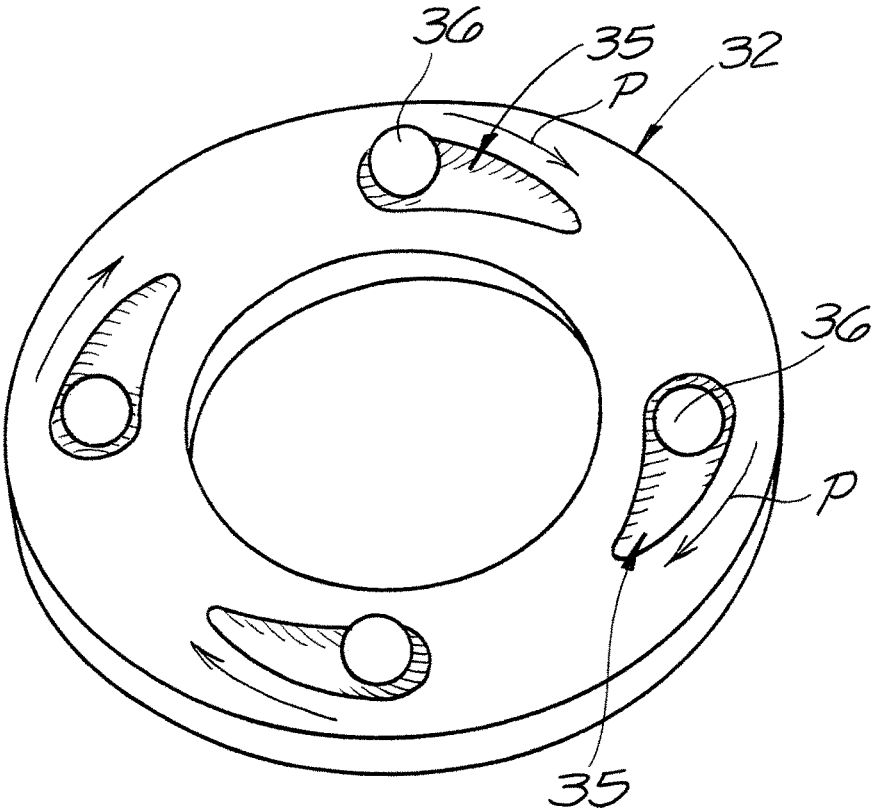
FIG. 10 shows a tenth embodiment of the invention.

Finally, FIG. 10 shows an embodiment in which a rotatable adjusting ring 32 is also provided as an actuating element, although this adjusting ring 32 has several recesses that are formed as guides and in which a respective rolling body, for example a ball 36, is guided. These balls 36 rest against the clamping elements 22, 23, for example the clamping ring 22 or the clamping segments 23. The balls can rest directly against either the clamping ring 22 or the clamping segments 23. Preferably, however, the clamping ring 22 is also equipped with corresponding recesses. This is not shown in the figures. In this case, however, the balls 36 are guided both in the guides 35 of the adjusting ring and in the corresponding guides of the clamping ring that are not shown. In principle, the guides 35 can be tapered over their length in a wedge shape and have a tapering width. Especially preferably, however, they are not only tapered over their width but are also formed as pocket-like guide grooves 35 whose depth decreases from one end of the groove to the other end of the groove (in the direction of the arrow P), so that the balls rest on the rising base of the groove on rotation. In the illustrated embodiment, the balls 36 are shown as guide bodies. Alternatively, however, other rolling bodies such as cylinders or also sliding bodies, in principle, can also be used. Details are not shown. Moreover, it can be seen in the figures that locking fittings 37 are connected to the clamping flanges 20 of the casing segments 19 that coact with complementary locking fittings 38 on the housing parts or the adapters 11, 12 in order to prevent rotation and axial movement. In the illustrated embodiments, projections 37 are connected to the casing segments that are T-shaped and engage in complementarily shaped grooves 38 of the adapters 11, 12. In the illustrated embodiments, the projections 37 are not integrally formed with the casing segments 19 but manufactured as separate parts and fastened with screws 39 to the casing segments 19.

Moreover, the set screws shown in the illustrated embodiments can also be replaced by other comparable linear actuators, for example adjusting pin, and particularly also by linear drives, such as cylinder piston assemblies or the like.

The invention claimed is:

1. An eccentric screw pump comprising:

an axially split stator made of an elastic material and extending along an axis; a rotor rotatable in the stator at least generally about the axis;

a casing surrounding the stator at least in some regions and formed by at least two casing segments clampable radially against the stator, each casing segment having opposite ends each in turn having a clamping flange with a first clamping surface; and respective first and second clamping elements with second clamping surfaces displaceable axially against the first clamping surfaces of the clamping flanges, the first and second clamping surfaces being angled relative to the axis and to each other so as to press the casing segments radially against the stator on axial displacement of the clamping elements.

2. The eccentric screw pump defined in claim 1, wherein the stator is formed by stator segments or subshells.

3. The eccentric screw pump defined in claim 1, wherein the first clamping element or the second clamping element is a wedge.

4. The eccentric screw pump defined in claim 1, wherein the clamping elements are rings bearing against the first clamping surfaces of the clamping flanges.

5. The eccentric screw pump defined in claim 1, wherein the clamping elements are each formed by an annular array of clamping segments that coact with the first clamping surfaces of the clamping flanges.

6. The eccentric screw pump defined in claim 1, further comprising:

actuators for displacing the clamping elements axially against the respective flanges and thereby pressing the first clamping surfaces against the second clamping surfaces.

7. The eccentric screw pump defined in claim 6, wherein the actuators are set screws, adjusting rods, clamping rods or clamping levers that act on the clamping elements.

8. The eccentric screw pump defined in claim 6, wherein the actuator is a rotatable adjusting ring or a rotatable adjusting ring assembly that axially displaces the clamping elements on rotation.

9. The eccentric screw pump defined in claim 1, further comprising:

a clamping subassembly that has a double wedge ring having the second clamping surfaces and enclosing the casing segments and two clamping rings that can be pressed against one another and have the first clamping surfaces.

10. The eccentric screw pump defined in claim 9, wherein each of the clamping rings is rotatable and moves axially on rotation.

11. The eccentric screw pump defined in claim 1, wherein locking recesses or projections, are provided on the casing segments or the clamping flanges that prevent rotation or axial movement of the casing segments by coacting with projections or recesses on a housing part of a pump or on separate adapters.

12. The eccentric screw pump defined in claim 1, wherein the first and second clamping surfaces are frustoconical and complementarily axially angled relative to the axis.

13. An eccentric screw pump comprising:

an axially split stator made of an elastic material and extending along an axis;

a rotor rotatable in the stator at least generally about the axis;

a casing surrounding the stator at least in some regions and formed by at least two casing segments clampable radially against the stator, each casing segment having opposite ends each in turn having a clamping flange with a first clamping surface;

respective clamping elements with second clamping surfaces displaceable axially against the first clamping surfaces of the clamping flanges, the first and second clamping surfaces being angled relative to the axis and to each other so as to press the casing segments radially against the stator on axial displacement of the clamping elements, the clamping flanges and the clamping elements are rings at least one of which has a multipart configuration and consists of an outer ring and an inner ring, the second clamping surfaces being on the inner rings; and respective actuators bearing on the outer rings for displacing the clamping elements axially against the respective clamping flanges and thereby pressing the first clamping surfaces against the second clamping surfaces.

* * * * *